US005364470A

United States Patent [19]

Greenberg

[11] Patent Number: 5,364,470

[45] Date of Patent: Nov. 15, 1994

[54] COLOR BLOOM PAINTING SYSTEM

[76] Inventor: Allen Greenberg, 3531 N. 47th Ave., Hollywood, Fla. 33021

[21] Appl. No.: 77,074

[22] Filed: Jun. 16, 1993

[51] Int. Cl.[5] ..... B05C 5/00

[52] U.S. Cl. ..... 118/500; 434/81

[58] Field of Search ..... 118/500; 206/457, 557; 434/84, 81

[56] References Cited

U.S. PATENT DOCUMENTS 3,680,225 8/1972 Ishida ..... 434/84
5,163,846 11/1992 Lee ..... 434/84
5,310,579 5/1994 Fornataro ..... 118/505

*Primary Examiner*—W. Gary Jones

*Assistant Examiner*—Laura E. Collins

*Attorney, Agent, or Firm*—Wegner, Cantor, Mueller & Player

[57] ABSTRACT

A painting system made up of a porous substrate sheet mounted on an impermeable support, the sheet having preformed therein a picture in outline, the outline being waterproof barrier bands which thereby form discrete segments within the porous sheet, there being disposed in the sheet a multiplicity of concentrated dye spots whereby addition of water to the porous sheet causes dissolution of the individual dye spots and migration of dissolved dye within each segment of the porous sheet to the limits set by the aforementioned barrier bands, ultimately forming the picture that had been outlined in the porous sheet by the barrier bands.

6 Claims, 4 Drawing Sheets

COLOR BLOOM PAINTING SYSTEM

This invention relates to a painting device and to a method for coloring an already outlined and framed painting.

BACKGROUND OF THE INVENTION

The rationale of this invention is to satisfy the desire of primary grade school age and pre-school age children, even adults, to generate artistic designs and pictures during the course of their playtime. The device of this invention is directed principally to children, ages 4–12.

SUMMARY OF THE INVENTION

In the device of this invention a (substrate) sheet has thereon a picture or a design, whatever, pre-formed in outline thereon. Also on the sheet are dye spots which contain all of the color(s) needed to complete the picture or design. Upon addition of water to the sheet, the colors dissolve and spread so that ultimately the picture or design on the substrate sheet is generated (in full color).

BRIEF DESCRIPTION OF THE DRAWINGS

For further understanding of the present invention, reference is now made to the accompanying drawings, whereon

DESCRIPTION OF THE INVENTION

Figure 1:
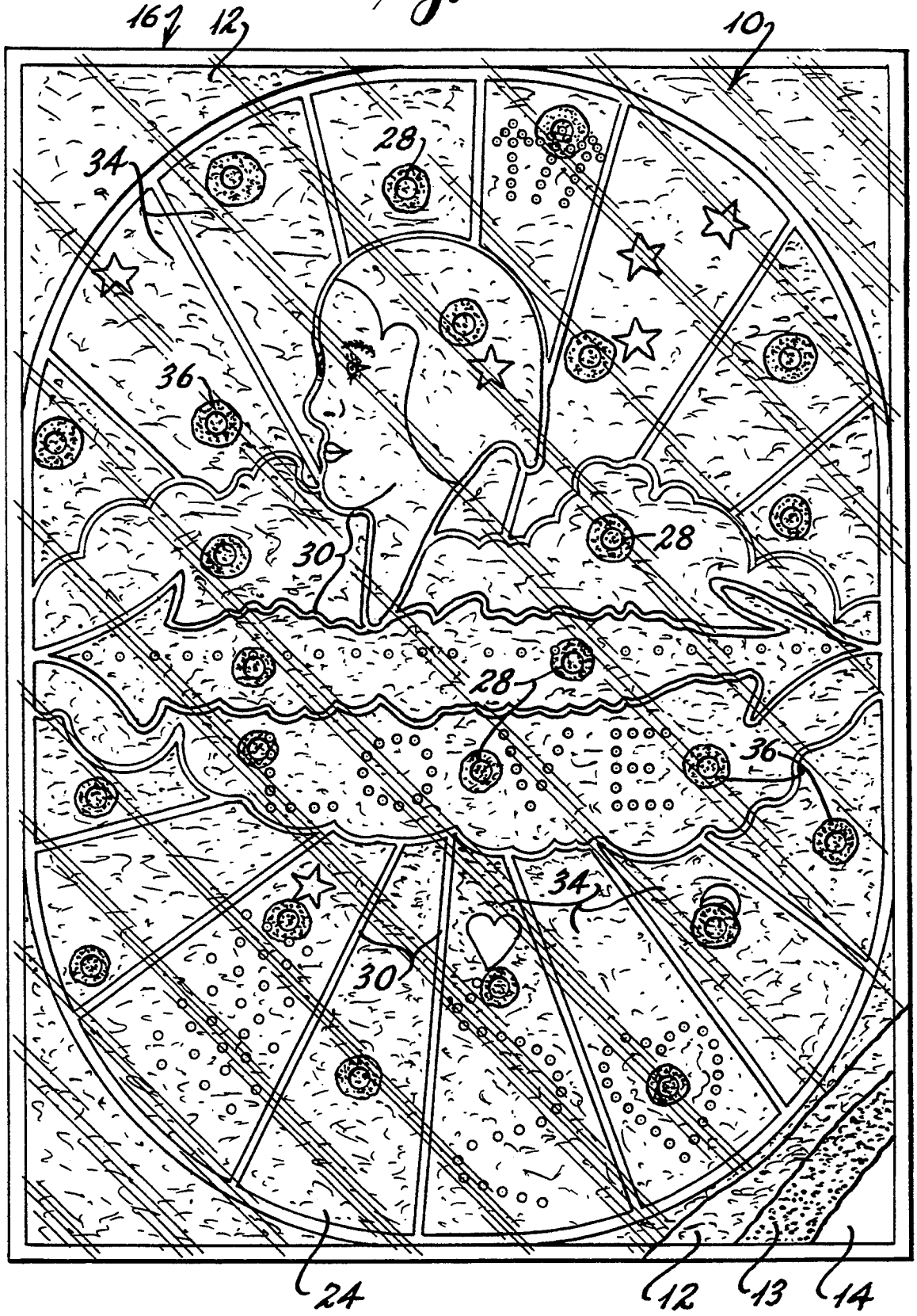
FIG. 1 is a top view pictorial representation of the framed substrate sheet with a picture and background design elements preformed in outline thereon.
Figure 3:
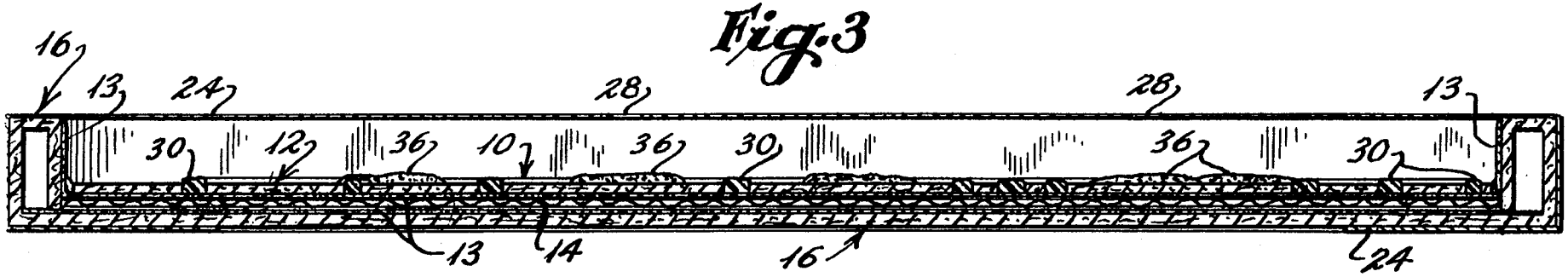
FIG. 3 is a section taken through line 3—3 on FIG. 1.
Figure 4:
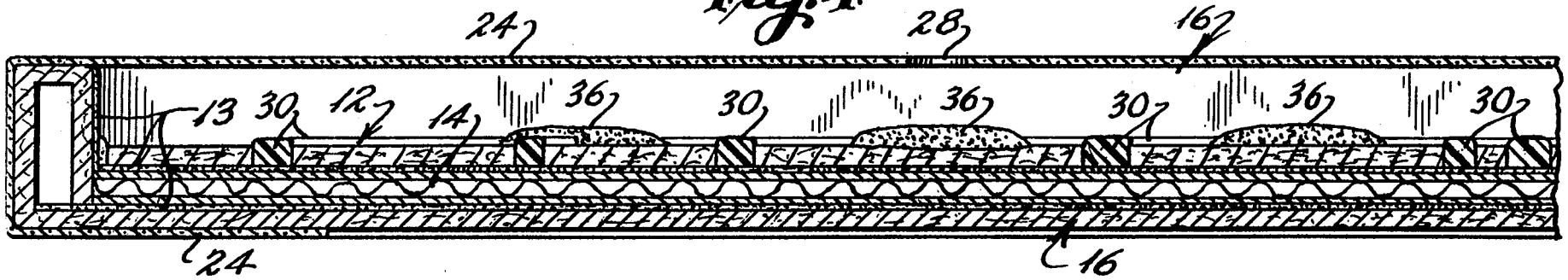
FIG. 4 is an enlarged partial section taken along line 4 on FIG. 1.
Figure 10:
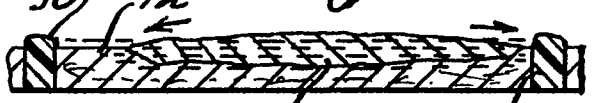
FIGS. 9, 10, 11 and 12 are enlarged partial section pictorial representations which illustrate the effect of water additions to a dye spot on the substrate sheet.
Figure 9:
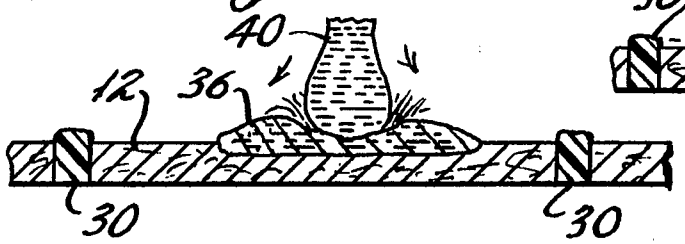
Figure 11:
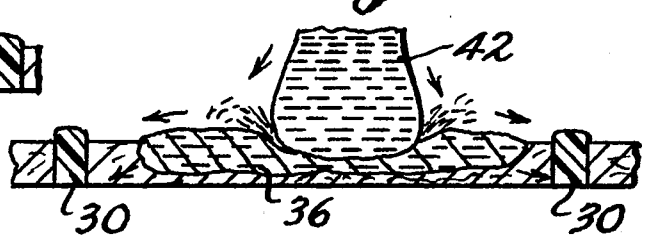

Referring now to the drawing and in particular to FIGS. 1, 3 and 4 whereon may be seen a substrate sheet assembly 10 which is contained inside of raised frame 16 and comprises a porous sheet 12, usually a paper sheet, for example a pure cellular paper 0.018 inches thick, nylon reinforced, which sheet is laminated to a base support backing 14 by an adhesive layer 13. Conveniently, support backing 14 is a cardboard or is (as exemplarily illustrated) a lightweight commercially available corrugated paperboard of the sort made from (brown wrapping paper grade) sheets of paper glued as facings to a corrugated spacer sheet (usually made from recycled paper). A waterproof adhesive layer 13 laminates the porous substrate (paper) sheet 12 to the (cardboard or paperboard) support backing 14.

The water impermeable nature of the layer 13 of adhesive film which joins porous sheet 12 to base support backing 14 is important to this invention. Layer 13 is intended to prevent water applied to the porous substrate sheet 12 from penetrating into the backing 14. Fortunately the (waterproofing) objective for layer 13 is readily obtainable. Any of the many non-toxic water insoluble film former adhesives commercially available (e.g., a rubber cement such as MMM #77) can be employed to generate the water impermeable layer 13 which laminates porous sheet 12 to backing 14.

Thus, layer 13 and backing 14 provide a water resistant structural support for porous substrate sheet 12. Accordingly, sheet 12 may be quite flaccid as well as highly porous. As an aside, it is noted that the backing 14 for the porous substrate sheet 12 is preferably a relatively high wet strength substance, e.g., cardboard as herein illustrated or alternatively a water resistant plastic piece, or foam, or a thick (plastic) film, or a metal sheet or paperboard, since the backing member might well become wetted through pin holes or other unintended passageways through the adhesive layer 13. Suffice it to say once again, that an important purpose of backing 14 and of adhesive layer 13 is to retain thereon all water applied to porous substrate sheet 12.

It may be seen best in FIG. 3 and FIG. 4 that the substrate sheet assembly 10 is contained inside of the raised frame 16 which borders assembly 10. Ordinarily the frame 16 will offer an ornamental appearance but the principal purpose of frame 16 is to act as a containment member to retain within the bounds of frame 16 any and all water applied to the porous sheet substrate assembly 10. Accordingly, the juncture region between frame 16 and substrate assembly 10 is waterproofed, e.g., by extending the layer 13 of (the same) adhesive appropriately. For example, the four side members of frame 16 which upstand from substrate assembly 10 ⅛–1 inches, may be formed from plastic, foam, metal or any other suitable material. Herein illustrated are paperboard strips wrapped by a high-wet strength wrapping paper and then glued to the marginal edges of the substrate assembly 10 with a layer of waterproof adhesive, e.g., rubber cement. Accordingly, the overall painting device 35 of this invention comprises the substrate assembly 10, framed so as to keep water from leaking out the side edges through frame 16 and/or out the bottom through porous substrate sheet 12 and backing 14 (such being the assembled painted device 35 illustrated in FIG. 2).

As an aside it is noted that the frame 16 need not be a member separate and distinct from backing 14. Upturned sides on backing 14 can serve as the frame 16 and such is contemplated as being the frame 16 to which backing 14 is secured.

Stretched across frame 16 from one side to the other is a water impermeable (thin) transparent plastic sheet 24. Sheet 24 has a multiplicity of spaced-apart apertures 28 therein (through which water may pass). Thus, the transparent apertured sheet 24 overlays the porous substrate sheet 12 (e.g., of paper) but is spaced therefrom by about the ⅛–1 inch height above sheet 12 of the four side members on frame 16.

It may be seen in FIGS. 1, 3 and 4 that in the porous substrate sheet 12 are a multiplicity of impregnant bands 30; some linear, some curved, some shaped into designs which divide sheet 12 into many segments 34. Although bands 30 may be pigmented in the mode herein illustrated in the drawing, bands 30 are colorless and may be seen on the white substrate sheet 12 as a shade of white-on-white. Rubber cement and acrylic emulsion adhesives are preferred for forming bands 30. The purpose of the numerous impregnant bands 30 is precisely to partition the porous substrate sheet 12 into as many segments 34 as are needed so as to correspond in area to the differently colored portions of the ultimate painted picture, all as exemplarily illustrated in Fig. 2.

Figure 12:
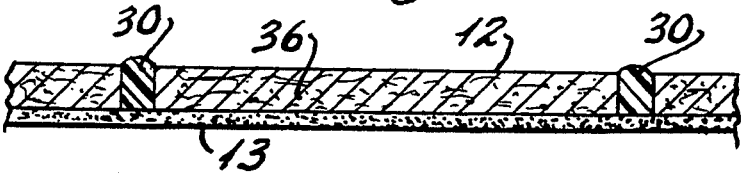

Suitably, the impregnant bands 30 are painted, so to speak, into the porous substrate sheet 12 with a (colorless) water insoluble barrier substance, e.g., an acrylic emulsion. Wherefore, the mechanical and chemical bonds between impregnant and the fibers of sheet 12 cause each band 30 to be a (waterproof) barrier against lateral diffusion of water in the porous substrate sheet 12 past the band. The closed shape of a band 30 creates a wall through the substrate sheet 12 which attaches to the previously created waterproof barrier 13. The result is to create a three-dimensional water containment structure. The degree to which bands 30 constitute a barrier may be seen in FIGS. 4 and 12, including that bands 30 extend (almost imperceptibly) above the surface of porous substrate sheet 12. As a result, bands 30 compartmentalize substrate sheet 12 into a multiplicity of discrete segments 34 within porous sheet 12 so as to prevent undesired migration of water and color from one segment into the next segment within the porous substrate sheet 12.

Figure 2:
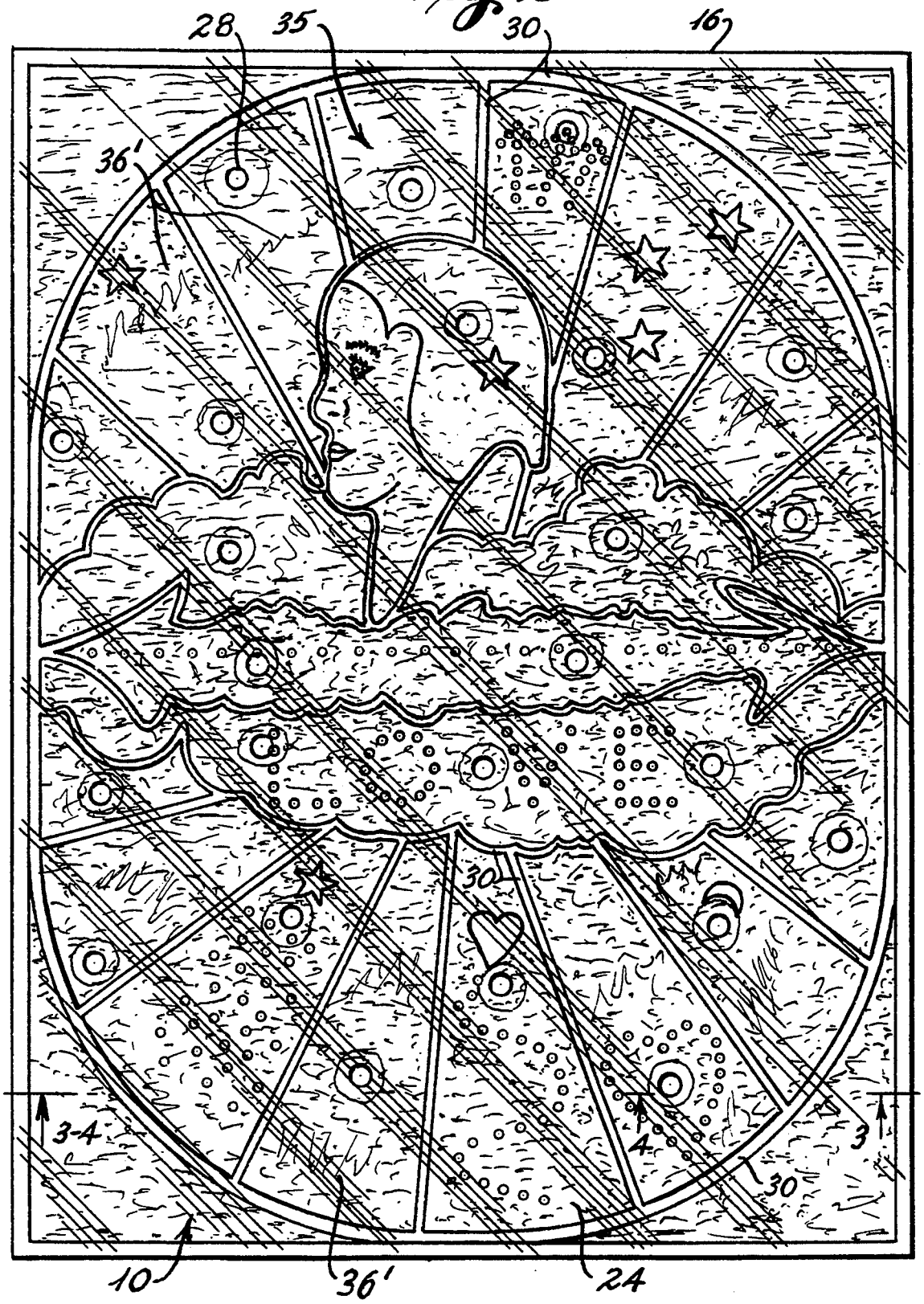
FIG. 2 is the same top view pictorial representation of the framed substrate sheet after the picture preformed thereon has become fully colored.

Thus, ultimately (i.e., in the fully colored) the bands 30 become color boundary lines and, as desired, the bands 30 also serve as design elements in the picture, all as can be seen in FIG. 2. Of course the bands 30 need not be transparent but even when colorless, as illustrated herein, the bands 30 may be seen as such because an optical difference is generated in the substrate sheet 12 by presence of whatever impregnant substance is used to form the bands 30. A visually ascertainable white-on-white difference between band 30 and the paper of the substrate sheet 12 is exemplarily illustrated.

As is evident in FIGS. 1, 3 and 4, each segment 34 on porous sheet 12 will ordinarily contain therein one or more spots 36 (rarely more than one per segment and none in segments that remain without color); spot 36 is formed from concentrated dried water-soluble non-toxic dye. Desirably, non-toxic dyes are used to generate spots 36 (for safe use by young children), notably the Food, Drug & Cosmetic (FD&C) and Drug & Cosmetic (D&C) dyes. Presence of at least one dye spot in each colored segment 34 of the finished painting 35 is a structural feature of this invention. Artistic liberty allows for two or more dye spots 36 to be present so as to obtain (unusual) variegated color affects and also, if more convenient, in elongated and narrow segments 34 within the painting 35. Of course, in segments which form those regions in the painting 35, such as corners of substrate sheet 12 that are not intended to be colored (in the ultimate picture), a dye spot will not be present. The individual dye spot 36 in substrate sheet 12 is generated by placing a concentrated solution (usually in distilled water) of dye or combination of dyes at the predetermined location on substrate sheet 12, then evaporating to dryness.

The total number of dye spots 36 and the dye content for each dye spot 36, as well as their colors, constitute artistic choices in practice of the invention and they will vary picture to picture. However, certain guidelines for the artistry can be offered hereinafter.

Adjacent each dye spot 36 in porous substrate sheet 12 is an aperture 28 in plastic sheet 24. Desirably each aperture 28 in plastic sheet 24 is actually centered over the subjacent dye spot 36 on porous substrate sheet 12. The purpose of plastic sheet 24 is to channel water added to substrate sheet 12 to the location of each dye spot 36. Such has been done by providing the apertures 28 adjacent the dye spots 36. It follows then that adding water through the apertures 28 to the porous substrate sheet 12 (see FIGS. 5–8 and 9–12) directly wets the dye spot 36.

FIGS. 5–8 and 9–12 illustrate the sequence of water addition through aperture 28 to the subjacent due spot 36.

COLORING THE PAINTING

Figure 5:
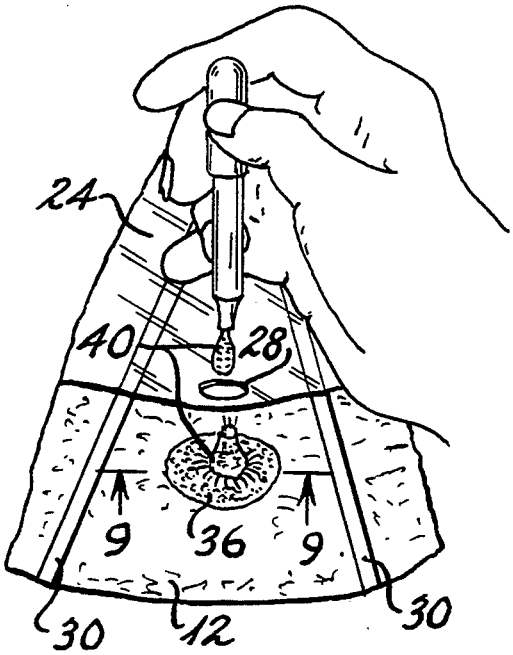
FIGS. 5, 6, 7 and 8 are pictorial representations which illustrate the effect of water additions to a dye spot on the substrate sheet.
Figure 6:
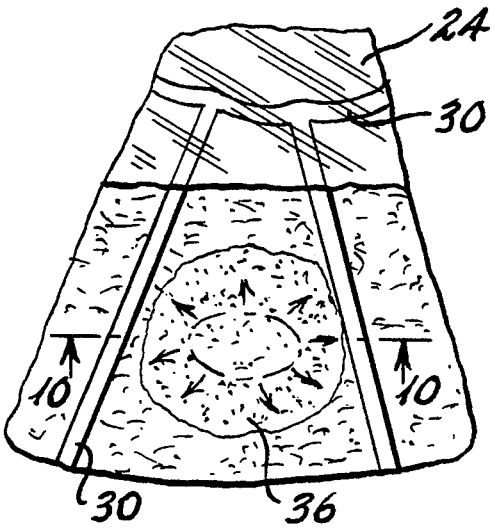
Figure 7:
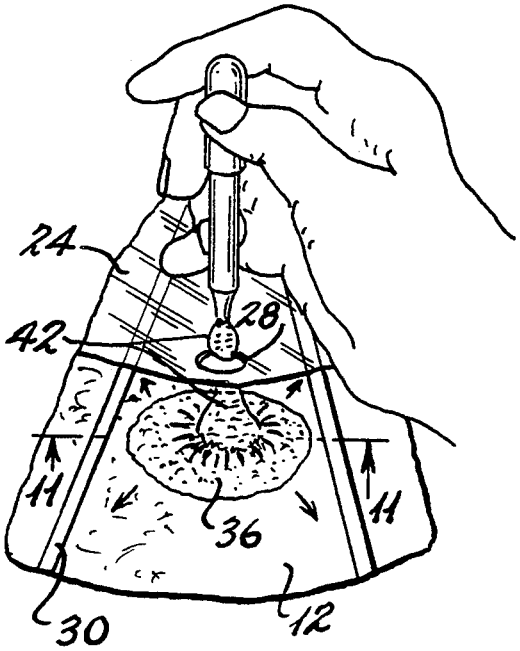
Figure 8:
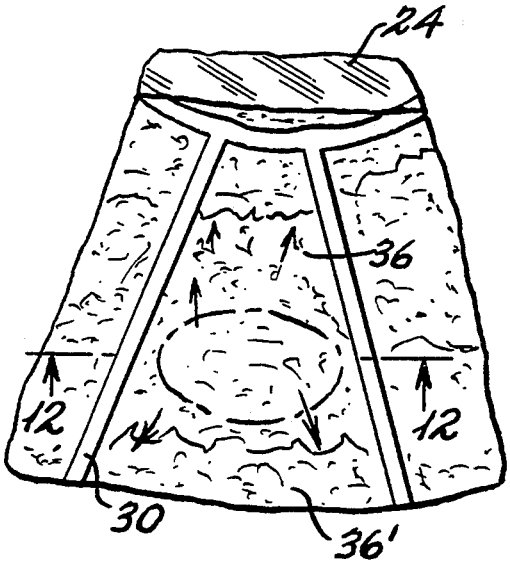

Passage of water through the apertures 28 onto the dye spot 36 of the porous substrate sheet 12 causes several things to happen (see FIGS. 5–8 and 9–12). First, the water wets porous substrate sheet 12 and dissolves dye from the dye spot, and then the water migrates or diffuses laterally through the sheet in all directions away from the dye spot 36, all as illustrated in Figs. 5 and 6, to alternate dye spot 36. Upon continued addition of water the dye dissolves completely and dye spot 36 vanishes. Ordinarily the initial drops 42 of water should be distilled water or tap water, since most of the dyes contemplated for practice of the invention are more soluble in distilled water than in salt water. After the dye is dissolved later additions of water, e.g., the water drop 42 illustrated in FIG. 7, may advantageously be a salt water.

Ultimately the water (and dye) diffusing laterally through the porous substrate sheet 12 migrates as far as the segment boundaries generated by bands 30 (see FIGS. 9–12) will allow, which then halts the spread of water and dye 36. Thus, positioning the entry point for water directly over each dye spot 36 so that the water which enters at the dye spot 36 first dissolves dye into the water, whereupon the migrating water carries with it some dissolved dye which colors the entire segment 34. More water will be added at the aperture 28, until enough water has been applied to the dye spot 36 to dissolve dye spot 36 and carry the dyes throughout the segment until all of the segment eventually becomes wetted and colored. In the end the entire segment has become uniformly wetted, and the desired coloration for segment 34 has been generated. Thus, the ultimate completed picture 35 forms by itself, segment by segment so to speak, as water is added through the different apertures 28 onto substrate 12, after which water and dye migrate throughout substrate sheet 12 to generate the picture, segment by segment.

As an aside, it is noted that water addition is controlled so that although the water dissolves dye spot 36 and migrates through porous sheet 12, it does not puddle and overflow barrier bands 30. Desirably all of the water is absorbed within porous sheet 12. In time all the water evaporates to leave behind a dry, completed painting 35.

Discussion of the Invention

Since whatever color ultimately is present in each particular segment 34 of the completed picture 35 will (initially) be contained within the dye spot(s) 36, an appropriate dye spot must be generated to begin with. As has already been pointed out, dye spot 36 is applied to substrate sheet 12 in the form of a concentrated solution of dye usually dissolved in distilled water, typically as a saturated solution of dye. Then the porous sheet 12 is dried to leave behind (dry) dye spots 36.

Accordingly, to allow for artistic variation, practice of the invention contemplates placing more than one dye in each dye spot. Besides, such is a necessity when a mixed color like green is sought, e.g., Blue No. 1 and Yellow No. 5 together generate a green colored segment. In addition, predetermined quantities of dye as needed for the artistry in each segment 34 are placed in the dye spots readily. Such requires nothing more than adding an appropriate quantity of the concentrated dye solution(s) to the location for a dye spot 36 sequentially (followed by drying) or in an admixture. Thus, the size and content of each individual dye spot 36 depends on the artistic affect sought to be achieved. One spot will be larger or smaller than other dye spots in substrate sheet 12, according to how much dye is present in such dye spot. For children under 8 years old, a reasonable size for the dye spot is $\frac{3}{8}$–$1\frac{1}{4}$ inch in diameter, which restated is about 10–100 μl in (concentrated) dye volume. For adults the dye spot may be made somewhat smaller, e.g., $\frac{1}{4}$ inch in diameter or about 5 μl of dye, a diameter of $1\frac{1}{4}$ inch corresponds to about 100 μl.

The non-toxic (water soluble) colors nature, e.g., the Food, Drug & Cosmetic (FD&C) or Drug & Cosmetic (D&C) colors, which are preferred to practice of the invention, can be dissolved in distilled water (along with a preservative if such is desired) for offering safety to the child. A usual dye concentration of FD&C or D&C dyes for preparing dye spot 36 is about 10% dye by weight (in distilled water). More generally, dye concentration is a matter of choice. Yellow dyes (which are more soluble than most other dyes) can be in a relatively concentrated solution (20–30%); the relatively poorly dissolving colors can be formulated in a less concentrated solution, say as low as 3% without generating excessively large dye spots. Whatever the concentration the solution of dye is applied to the locale for a dye spot and the water is evaporated so as to form the (dry) dye spot 36.

As has already been pointed out, any water soluble non-toxic colors known to the art are usable in practice of this invention, but the FD&C and D&C colors are preferred.

Exemplary dyes that have been found suitable in practice of this invention are the following FD&C and D&C true colors:

| FD&C Colors | D&C Colors |
|---|---|
| Red 3 | Red 22 |
| Red 40 | Red 27 |
| | Red 28 (Neon) |
| | Red 33 |
| Yellow 5 | Yellow 8 (Neon) |
| Yellow 6 | Yellow 10 |
| Blue 1 | Orange 4 |
| Blue 2 | |
| Violet 1 | Green 5 |
| Violet 2 (external) | Green 8 (Neon) |

Following are exemplary created colors made by pure color combinations that are suitable for practice of the invention (proportions are by weight):

| Created Colors | |
|---|---|
| Red 44 | $3\ R_2 + 2\ R_{40}$ |
| Red 30 | $R_3 + 2\ R_{27}$ |
| Red 36 | $R_3 + 3\ R_{33}$ |
| Red 61 | $R_{28} + 2\ R_{33}$ |
| Red 68 | $R_{40} + 2\ R_{28}$ |
| Yellow 7 | $3\ Y_5 + Y_6$ |
| Orange 7 | $R_3 + 2\ O_4$ |
| Orange 13 | $R_3 + 4\ Y_{10}$ |
| Orange 33 | $R_{28} + 3\ Y_5$ |
| Orange 34 | $R_{28} + Y_6$ |

-continued

| Created Colors | |
|---|---|
| Orange 38 | $R_{28} + 3\ Y_{10}$ |
| Orange 1 | $R_3 + 3\ Y_5$ |
| Orange 2 | $R_3 + 2\ Y_5 + Y_6$ |
| Green 1 | $2\ Y_5 + B_1$ |
| Green 2 | $2\ Y_5 + 2\ Y_6 + B_1$ |
| Green 9 | $4\ G_8 + B_1$ |
| Green 13 | $4\ G_8 + G_5$ |
| Blue 3 | $2\ G_5 + B_1$ |
| Violet 2 | $2\ R_3 + V_2$ |
| Purple 5 | $R_3 + B_2$ |
| Purple 8 | $R_3 + 2\ G_5$ |
| Purple 33 | $R_{28} + 2\ G_5$ |
| Purple 1 | $R_3 + B_1$ |
| Black 1 | $3\ R_3 + 3\ Y_5 + B_1$ |
| Black 2 | $R_3 + Y_6 + B_1$ |
| Black 4 | $R_{22} + 2\ G_8 + B_1$ |
| Brown 1 | $2\ Y_5 + V_1$ |
| Brown 4 | $2\ R_3 + 2\ Y_5 + 3\ G_8 + G_5$ |
| Brown 5 | $V_1 + 2\ R_3 + 2\ Y_5 + G_8$ |
| Brown 6 | $R_3 + Y_5 + 2\ G_5 + 3\ G_8$ |
| Brown 9 | $O_4 + G_5$ |
| Brown 21 | $R_{22} + G_8 + G_5$ |
| Brown 11 | $R_{33} + G_8 + G_{10}$ |
| Brown 7 | $2\ Y_5 + 3\ V_{2ext}$ |

When the dye in a pure color dye spot 36 is dissolved in (distilled) water, then diluted upon further addition of water 40 to the dye spot 36, a colored blot spreads in all directions throughout porous sheet 12. Reduction in color value takes place as the color become more dilute (weaker) in some proportion to the level of dilution. However, the migrating water and dissolved dye is free to spread in the porous substrate 12 only so far as the bands 30 which bound the segment 34 in question. Since the quantity of dye in each spot 36 is a matter of choice, color value differences, segment to segment, are part of the artistry possible in the painting 35.

When a mixture of primary colors are used to form dye spot 36 the color changes which take place when water is added to dye spot 36 become striking; hopefully more interesting. Variegated color changes take place as the dye in dye spot 36 is dissolved and becomes attenuated. When several colors have been blended together in each dye spot 36 (e.g., using yellow and blue pure colors), substantial color variability is generated. And the variability is emphasized when dyes of different solubilities in water are employed so as to generate transitory and permanent variegated color affects. For example, when Blue No. 1 and Yellow No. 5 are combined to form a dye spot 36 in proportions to generate Green No. 1 (which of course is not a pure color, but is a created color) the spreading dye stain need not be colored green. In the instance of Blue No. 1 and Yellow No. 5, and use of a salt water (after an initial addition of distilled water drops 40 to dissolve the dye) addition of the salt water causes the colored blot to expand but (green) dye in the color blot disassociates into its component (primary) colors as the dye solution spreads in porous substrate sheet 12. A variegated generally radially shaped color blot results. Blue No. 1 is more soluble in salt water than is Yellow No. 5, which causes the outer fringe of the color blot to be blue while the slower dissolving yellow remains at the center of the colored blot (remaining near the location of the dye spot) and in between are various tones of green, because inside the colored blot the blue and yellow dyes interact in various proportions from center to fringe to generate many tones of green. If distilled or tap water is used for dilution of the same dye spot (instead of salt water drops 42)

wherein the yellow dye is more soluble, a different resulting color separation in the color blot results. In such instances, color separation in the colored blot, into a yellow center then shades of green and ultimately a blue periphery, does not take place until considerable dilution of the dye (from dye spot 36) has occurred and the color blot has spread nearly throughout its segment. Only rarely will the dyes merge ultimately so that a uniform non-primary color can fill the segment, e.g., green. Manifestly, trial and error efforts (by the artist) are necessary to achieve the transitory and permanent color changes and the ultimate coloring sought by the artist for each segment in painting 35.

Manifestly, much room has been left in practice of this invention for sheer artistry. Thousands of color combinations and color shades may be obtained with known to the art non-toxic dyes, e.g., FD&C and D&C colors. The inventor hereof has prepared many color combinations of the dyes listed heretofore with interesting transitory affects.

In addition, the bands 30 themselves may be colorless or colored so that those segment barriers become part of the ultimate painted picture 35, as has been illustrated in FIG. 2. Moreover, should such be desired by the artist, the bands 30 (colored or colorless) may be formed in the shape of hearts, half moons, lettering, whatever, so as to be a more integral part of the ultimate picture 35.

To repeat, all variations in quantity and content of dye in each dye spot 36, as well as the particular design or picture formed in porous substrate sheet 12, are considered to be matters of artistry; such is left for the artist to provide. Within the parameters provided heretofore for practice of the invention the artist is expected to offer directions to manufacturers of the embodiments of the painting device of this invention as to the location of the bands 30, the particular dyes and dye mixtures to be incorporated in the various dye spots 36, how much dye(s) and of course, exactly where to place each of the dye spots 36.

Be the artistry as it may, dye concentrate of some sort always will be incorporated in and on the porous sheet 12 as dye spots 36 and in addition (water barrier) bands 30 formed in porous sheet 12 with a waterproof impregnant substance which need not be colorless, always will divide porous sheet 12 into whatever multiplicity of segments is needed to generate the desired picture 35. At least one dye spot is provided in each segment that becomes colored in the ultimate painting.

Some characteristics are desired in preferred porous sheets 12, thus a paper sheet is preferred. Also a minimal wet strength is desired so that the substrate sheet does not disintegrate when wetted, as are uniform density, good color clarity and of course, porosity, all of which requirements are met by commercially available papers, filter paper for example.

Of course, differences paper to paper exist. The density and thickness of the paper used for porous sheet 12 determines the rate at which water added at a dye spot 36 becomes absorbed by the paper and the rate at which the (absorbed) water spreads in all directions from the point of entry, throughout the porous paper to the bounds set by bands 30. As an aside, it is noted that the water need not migrate in all directions through the paper sheet at the same rate. The paper may be anisotropic.

For paintings intended to be colored by young children, rapid absorbency of water is desirable to ensure that every drop of water added through apertures 28 is absorbed and that the colors do not run together. An exemplary paper for young children is one of pure cellulose, nylon reinforced and 0.018 inch thick. As has already been pointed out, dye spot diameter should be in the range of about $\frac{3}{8}$ to about $1\frac{1}{4}$ inch.

For adult usage the paper need not be highly absorbent and the dye spot diameter may be as small as $\frac{1}{4}$ inch. Adults are expected to be careful. Therefore the dye spots used in adult art may be made more concentrated, so to speak, and color variegation may be emphasized by the artist.

Mention has already been made that dye spots 36 are generated by adding a solution of dye, usually in distilled water to the substrate, followed by evaporating to dryness. Then later, when water is added to dye spots 36 (through the apertures 28) so as to begin to generate the ultimate picture 35, best results will be obtained if the first few drops of water 40 added to the individual dye spot 36 (e.g., from an eye dropper) are distilled water or tap water. However, to change the variegated transitory and permanent color change, the water subsequently added may well be a salt water (say a 2%–4% sodium chloride solution). The reason for the difference, fresh water then salt water, is that many of the individual FD&C and D&C dyes react differently to salt water than they do to fresh water. Commencing the coloration process with distilled or tap water dissolves the dye of the dye spot, after which addition of the salt water emphasizes solubility differences, dye to dye, which then cause dye separation in the spreading colored blot. The component colors, now a mixed dye, migrate away from the dye spot at different rates to generate thereby the variegated color effects. The user will see the different colors and shades of color spread from the dye spot 36 in an attractive sequence. First, dye most soluble in the salt water spreads, then dye less soluble; finally dye least soluble migrate from dye spot 36. The most soluble dyes migrate first to the outer boundary of the segment. The least soluble dyes generally remain near the original dye spot. Dyes in between in solubility spread only to intermediate distances from the original due spot. In time all colors spread through the segment and the ultimate coloration sought by the artist appears.

Although the embodiment of the invention herein illustrated might appear to constitute no more than a painting of the sort hung on a wall, such is not necessarily the case. If backing 14 is transparent, the completed picture 35 may be hung in a window, creating thereby the appearance of stained glass.

If, on the other hand, backing 14 is a flexible plastic film with adhesive on the rear surface thereof, the painting 35 may be applied as a decal to clothing, books, or even to a wall as a poster (in such instance it might be convenient to cut away or otherwise remove frame 16 from the painting 35. A flexible film backing (without adhesive on the rear surface thereof) might well be employed if the painting is intended to become a wall hanging rather than a poster.

Alternatively, instead of forming the painting 35 as a decal to decorate a three-dimensional object, the backing 14 itself may be a three-dimensional object, whereupon the painting 35 might, for example, become the frieze on a vase, or the decoration on a pendant or other piece of jewelry.

I claim:

1. A painting system which comprises:

1) a porous substrate sheet having thereon a picture, said picture being outlined;

2) a backing support for said porous sheet, a water insoluble barrier layer interposed between said porous sheet and said backing support adhesively laminating said porous sheet to said backing support; and 3) a frame to which said porous sheet and said backing member are secured, whereby water applied to said porous sheet is contained within said frame on said porous sheet;

said porous sheet having impregnated therein a multiplicity of bands formed from a water insoluble impregnant substance whereby said porous sheet is divided by said bands into a multiplicity of self-contained segments which together outline a painting and, a dye spot of concentrated water soluble dye on said porous sheet in every segment colored in the ultimate painting, whereby when water is added to a segment in said porous substrate sheet the water dissolves dye from the dye spot therein and a color blot spreads from the dye spot to the bands bounding such segment so that segment by segment addition of water colors the painting outlined in said porous sheet.

2. A painting system according to claim 1, further comprising a transparent film secured to said frame and stretched over said porous sheet and spaced apart therefrom by the depth of said frame, said film having a multiplicity of apertures therethrough, an aperture in said transparent film being located adjacent each dye spot so that water added to said porous sheet through an aperture becomes added directly at a dye spot.

3. A painting system according to claim 1, further comprising food, drug or cosmetic colors in said dye spots.

4. A painting system according to claim 1, wherein the backing is transparent.

5. A painting system according to claim 1, wherein the backing support is a flexible plastic with adhesive on a reverse side thereof.

6. A painting system according to claim 1, wherein the backing is a three-dimensional structure.

* * * * *